US010173799B2

(12) United States Patent
Miller

(10) Patent No.: US 10,173,799 B2
(45) Date of Patent: Jan. 8, 2019

(54) TUBE HOLDER FOR A FILLING MACHINE

(71) Applicant: Colgate-Palmolive Company, New York, NY (US)

(72) Inventor: Christopher Miller, Flemington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/548,045

(22) PCT Filed: Feb. 11, 2015

(86) PCT No.: PCT/US2015/015330

§ 371 (c)(1),
(2) Date: Aug. 1, 2017

(87) PCT Pub. No.: WO2016/130115

PCT Pub. Date: Aug. 18, 2016

(65) Prior Publication Data

US 2018/0016046 A1 Jan. 18, 2018

(51) Int. Cl.

*B65B 43/54* (2006.01)
*B65B 39/12* (2006.01)
*B65B 3/16* (2006.01)

(52) U.S. Cl.

CPC ..... *B65B 43/54* (2013.01); *B65B 3/16* (2013.01); *B65B 39/12* (2013.01)

(58) Field of Classification Search

CPC ..... B65B 43/00; B65B 43/54; B65B 3/16; B65B 7/14; B65B 37/00; B65B 39/00; B65B 39/02

(Continued)

(56) References Cited

U.S. PATENT DOCUMENTS 1,676,734 A 7/1928 Hopkins
2,391,528 A 12/1945 Walker et al.

(Continued)

FOREIGN PATENT DOCUMENTS

CN 1201970 C 12/1999
CN 204110418 U 1/2015

(Continued)

OTHER PUBLICATIONS

International Search Report and the Written Opinion of the International Searching Authority issued in International Application PCT/US2015/015330 dated Sep. 21, 2015.

*Primary Examiner* — Hemant M Desai
*Assistant Examiner* — Valentin Neacsu

(57) ABSTRACT

A tube holder is disclosed for carrying a tube to multiple processing stations of a tube filling machine. In one non-limiting embodiment, the tube holder includes a body comprising a receptacle configured for retaining a tube. The tube includes a dispensing end and an opposite open end for filling a cavity therein with a product. A retractable tube shaping device is movably disposed in the tube holder. The shaping device is movable between an extended position and a retracted position. When the shaping device is in the extended position, the shaping device engages the tube proximate to the open end and removes ovality which might interfere with the tube filling operation. In various embodiments, the shaping device comprises a plurality of vertically retractable straightening elements that engage the sidewalls of the tube to ensure circularity of the open tube end.

20 Claims, 12 Drawing Sheets

(58) Field of Classification Search
USPC ... 53/467, 468, 473, 266.1, 284, 381.1, 574, 53/578, 457; 141/9, 103, 114, 326, 100, 141/129, 275, 313, 369; 425/392–400, 425/403
See application file for complete search history.

(56) References Cited

U.S. PATENT DOCUMENTS

| | | | | |
|---|---|---|---|---|
| 2,835,091 | A | 5/1958 | Grant | |
| 2,881,727 | A | 4/1959 | Maddux | |
| 3,147,018 | A * | 9/1964 | Reichert | B65B 3/16 248/108 |
| 3,390,891 | A * | 7/1968 | Stichhan | B65B 3/16 269/254 R |
| 3,599,389 | A | 8/1971 | Hartman | |
| 3,819,194 | A | 6/1974 | Grevich et al. | |
| 4,406,607 | A | 9/1983 | Wildmoser | |
| 4,819,789 | A | 4/1989 | Linner | |
| 5,673,880 | A * | 10/1997 | Dexter, Jr. | B65D 35/56 248/101 |
| 6,959,739 | B2 * | 11/2005 | Linner | B29B 13/025 141/100 |
| 7,021,032 | B2 | 4/2006 | Linner | |
| 2005/0108995 | A1 * | 5/2005 | Chudoba | B65D 35/10 53/284 |
| 2005/0115208 | A1 * | 6/2005 | Linnr | B29B 13/025 53/469 |
| 2009/0084463 | A1 * | 4/2009 | Kohler | B65B 3/16 141/114 |

FOREIGN PATENT DOCUMENTS

| | | |
|---|---|---|
| DE | 845 023 | 7/1952 |
| DE | 3221436 C2 | 12/1984 |

* cited by examiner

402

TUBE HOLDER FOR A FILLING MACHINE

BACKGROUND

The present invention relates to tube filling machines, and more particularly to tube holders used with such machines.

Laminated thermoplastic tubes are commonly used for product packaging containing viscous materials. The nozzle and shoulder insert are typically thicker and more rigidly structured than the attached tubular sidewalls providing structure for the dispensing end and shaping for the tube. For unfilled tubes, the circular shoulders particularly help maintain the circularity of the adjoining sidewalls before the tubes are filled, at least closer to the nozzle end. The opposite end of the tube remains open and provides an entry into the internal cavity for filling the tube with the product. After filling the open end may be closed by crimping or capping.

The unfilled tubes are typically packaged and transported in bulk to the filling machine. The packaged tubes may be considerably deformed particularly at the sidewall area proximate to the open end which lacks support from the tube shoulder. The open end may partially collapse inwards and assume an oval cross sectional shape in which the sidewalls of the tube are no longer straight and parallel. This resulting ovality may interfere with the tube filling operation and product feed nozzles which are inserted into the open end of the tube. Tube filling machines can generally only tolerate ovality on the order of about 10%. This can limit the selection of tube materials to more rigid ones and the tube making process.

The ability to maintain circularity of the tube at the filling station is desired to reduce or eliminate the foregoing limitations.

BRIEF SUMMARY

The present invention may be directed, in one aspect, to a tube filling machine including a device operable to re-establish the circularity of a tube within acceptable ovality tolerances for filling.

In one embodiment, the invention can be a tube holder for carrying a tube to multiple processing stations of a tube filling machine. The tube holder includes a body comprising an open chamber configured for retaining a tube. The tube has an internal cavity for storing a product, a dispensing end, and an open filling end. A retractable tube shaping device is movably disposed in the body, the shaping device being movable between an extended position and a retracted position. When the shaping device is in the extended position, the shaping device engages the tube proximate to the open end and imparts a circular cross sectional shape to the tube for filling the cavity.

In another embodiment, the invention can be a tube holder for carrying a tube to multiple processing stations of a tube filling machine. The tube holder includes a body comprising an open circular chamber configured for retaining a tube in an upright position. The tube has an internal cavity for storing a product, a dispensing end, and an open filling end. A plurality of retractable straightening elements are movably disposed in the body and spaced circumferentially apart around the chamber. The straightening elements each comprise a bearing surface configured to engage the tube when seated in the chamber. The straightening elements are vertically movable between an upward extended position and a downward retracted position. When the straightening elements are positioned to engage the tube proximate to the open end, the straightening elements impart a circular cross sectional shape to the tube for filling the cavity.

In a further embodiment, the invention can be a method for filling a tube. The method includes: providing a tube including an internal cavity, a dispensing end, and an open filling end; providing a tube holder configured to hold the tube in an upright position, the tube holder including a retractable tube shaping device; inserting the dispensing end of the tube into the tube holder; vertically extending a tube shaping device movably disposed in the tube holder from a top surface of the tube holder towards an extended position; engaging an upper portion of the tube proximate to the open filling end with the shaping device; conforming the cross sectional shape of the upper portion to a target filling reference circle; and filling the cavity of the tube with a product material. The method may further include vertically retracting the tube shaping device back towards the top surface of the tube holder towards a retracted position after filling the cavity of the tube.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 4:
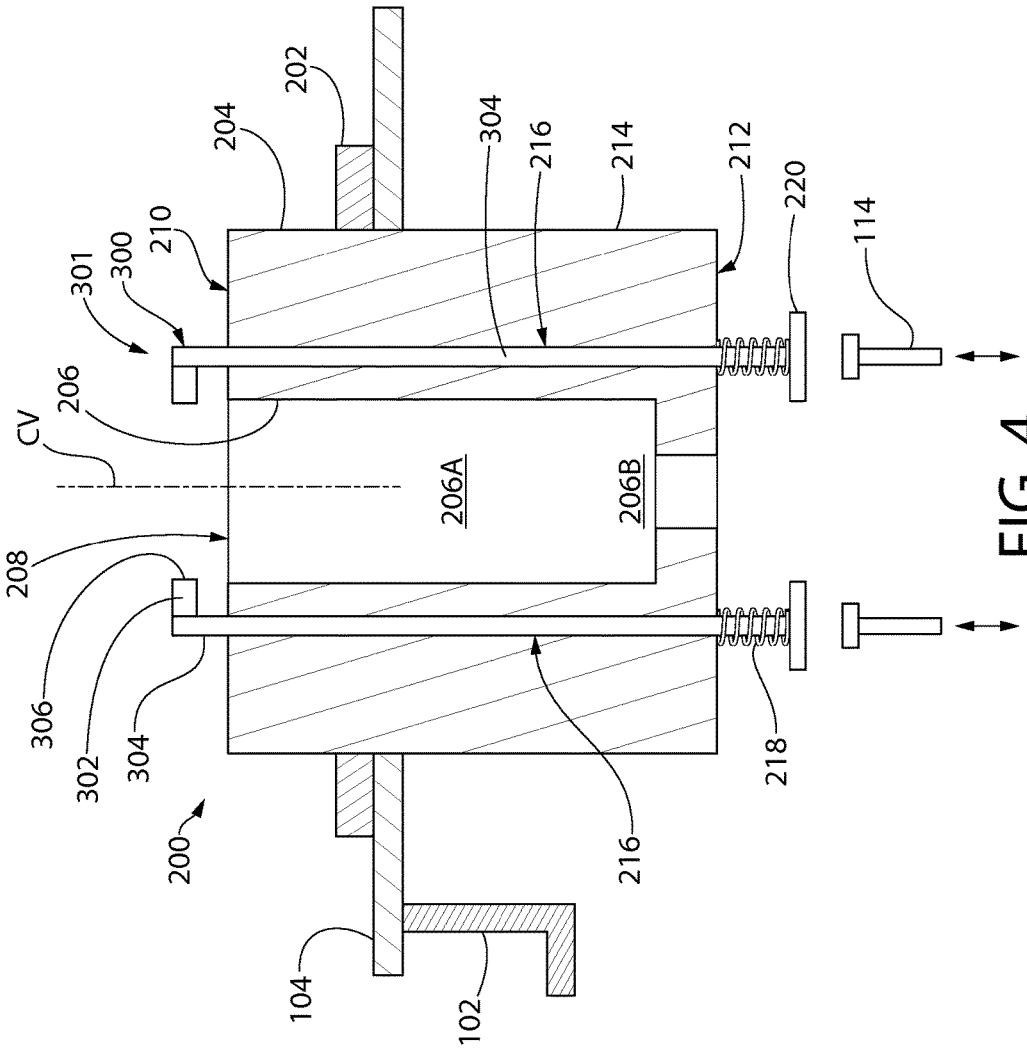
FIG. 4 is a side cross sectional view of the tube holder showing a first embodiment of a retractable tube shaping device.
Figure 10A:
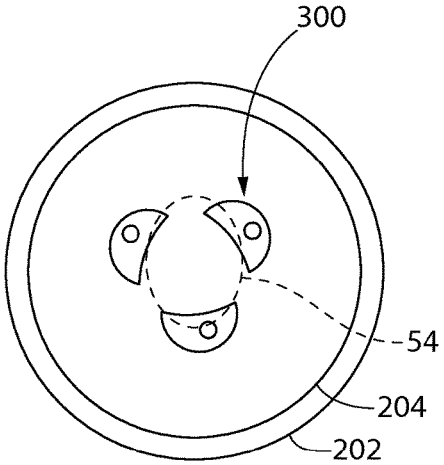
Figure 10B:
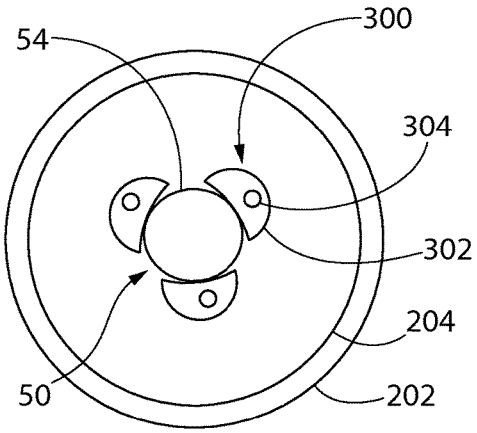
Figure 10C:
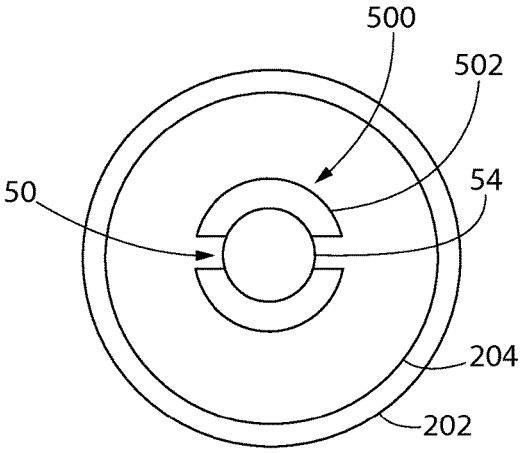
Figure 10D:
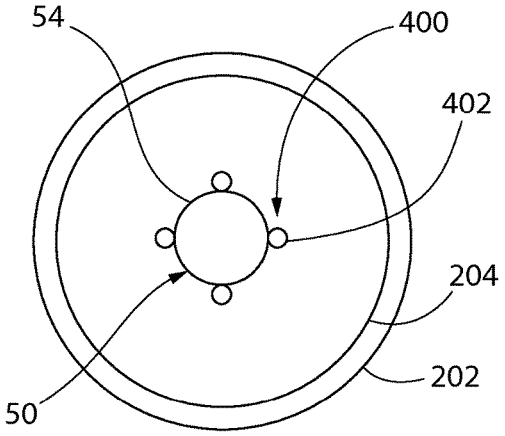
Figure 11:
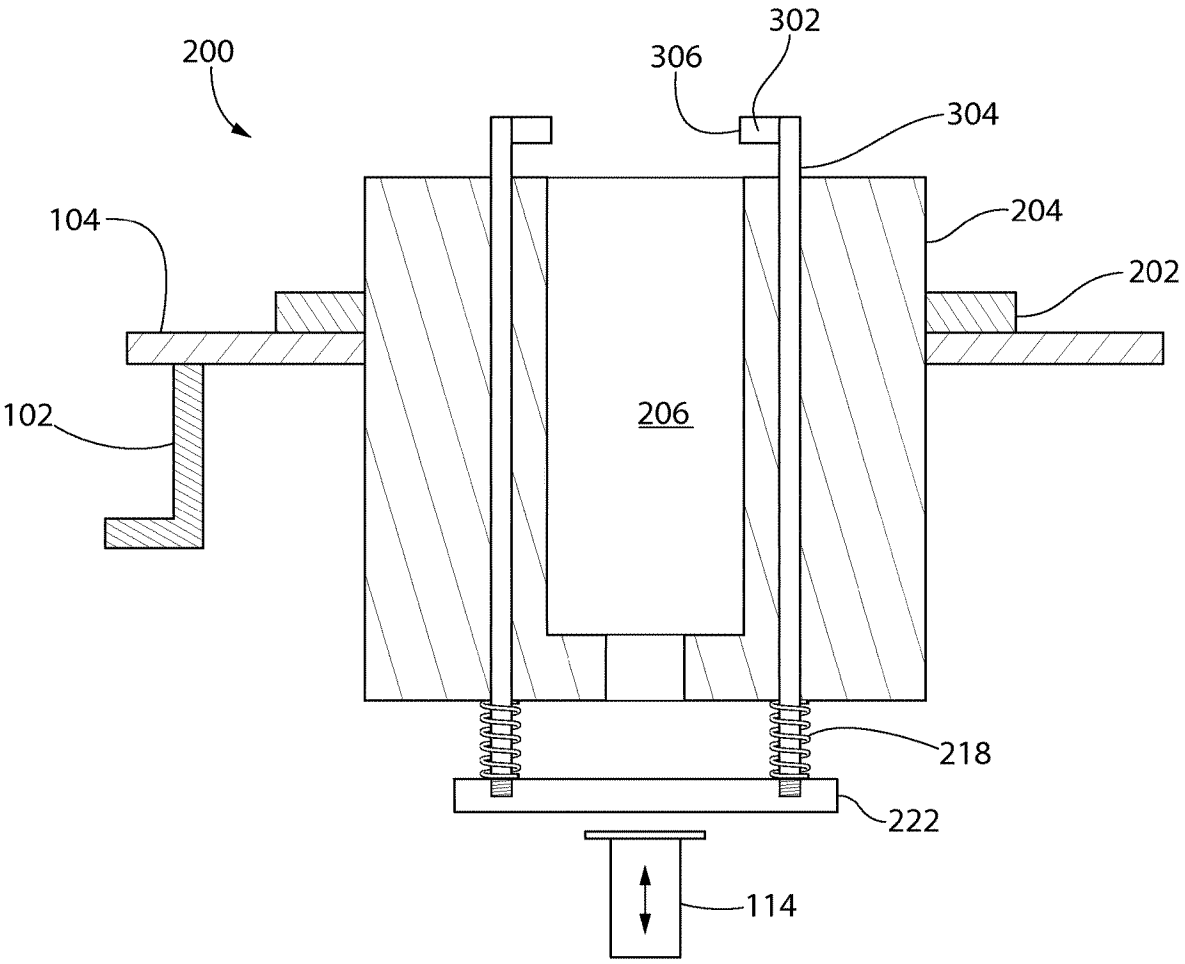
Figures 12A, 12B:
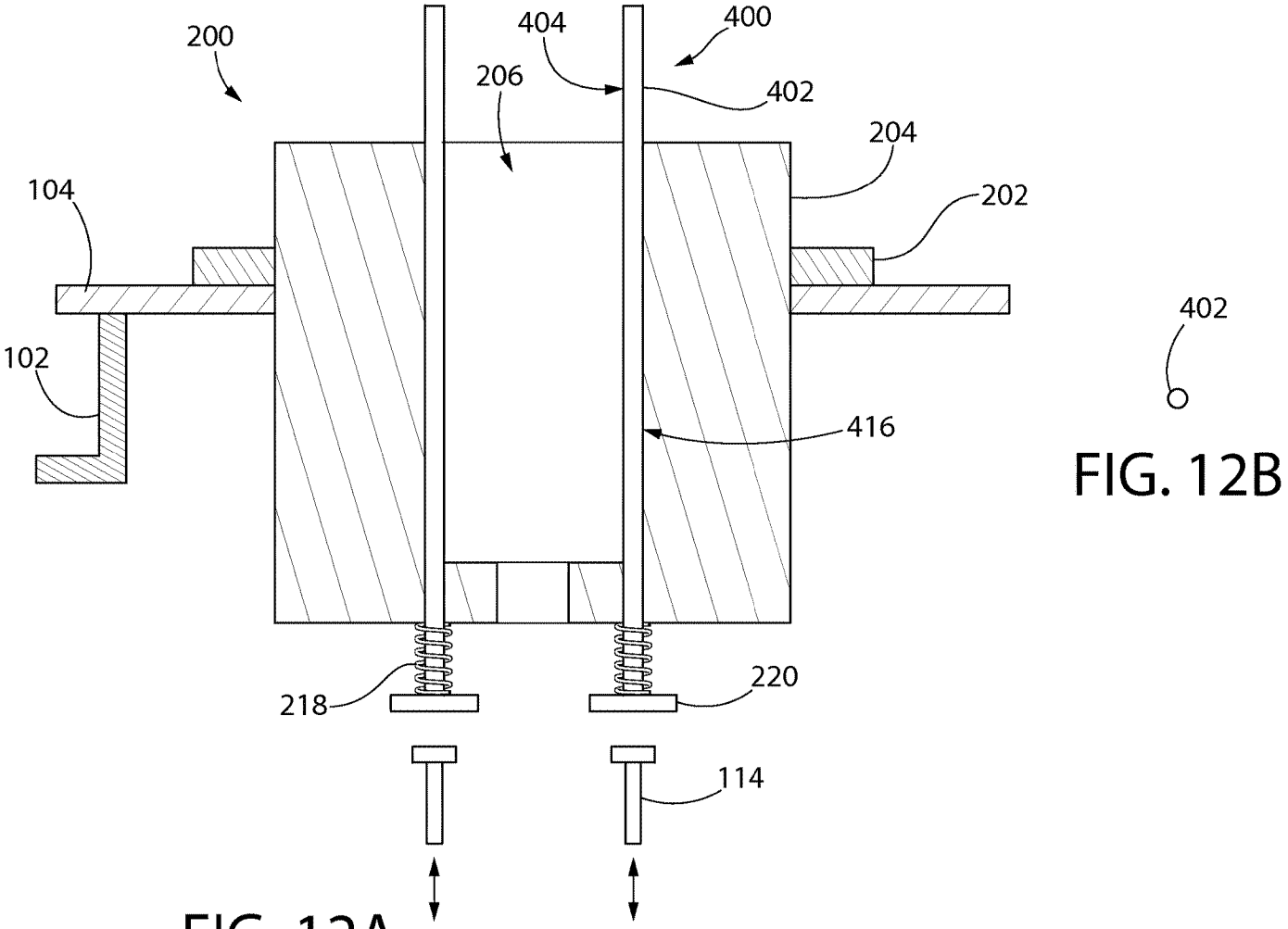
Figure 13:
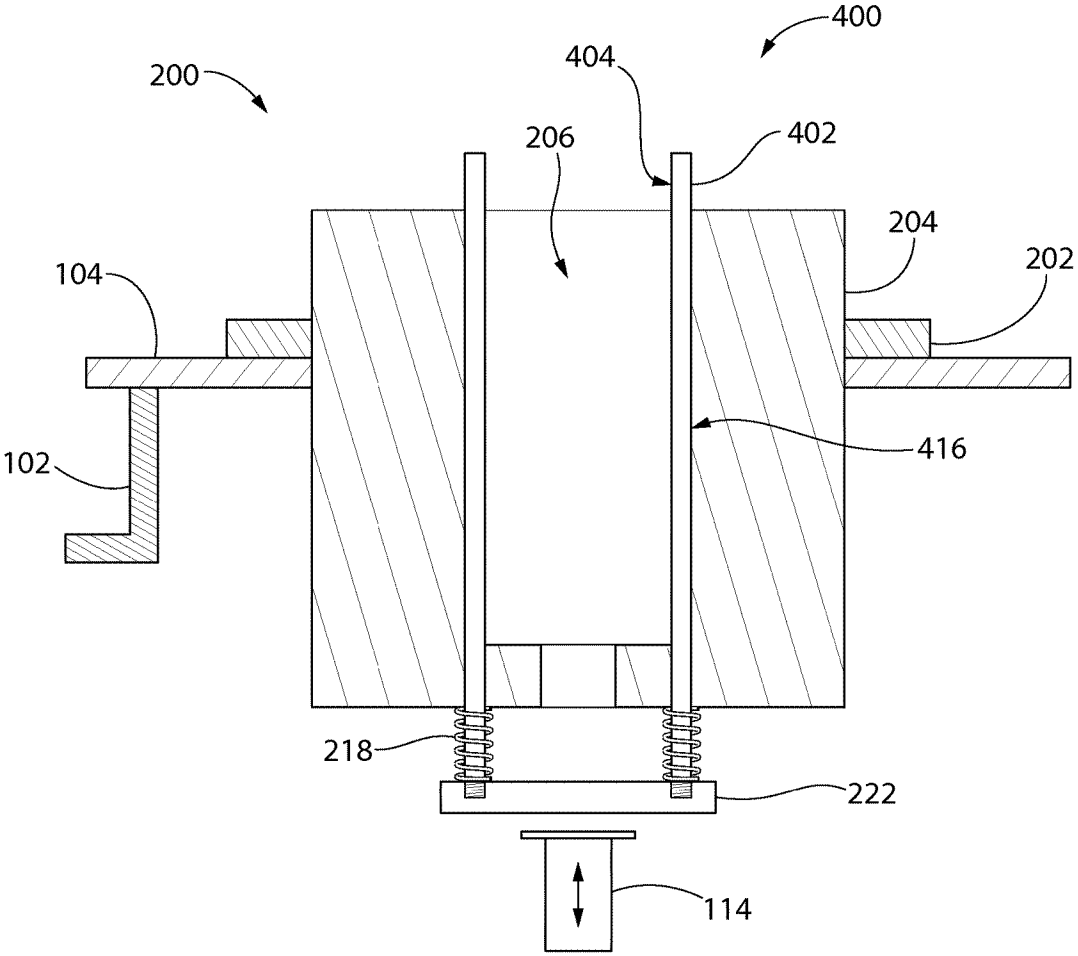
Figure 14B:
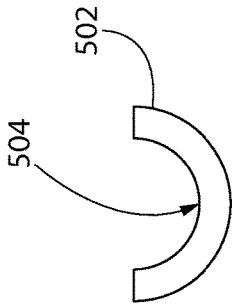
Figure 14C:
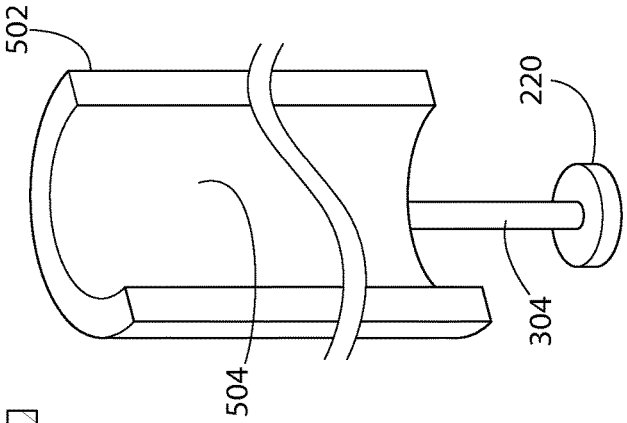
Figure 14A:
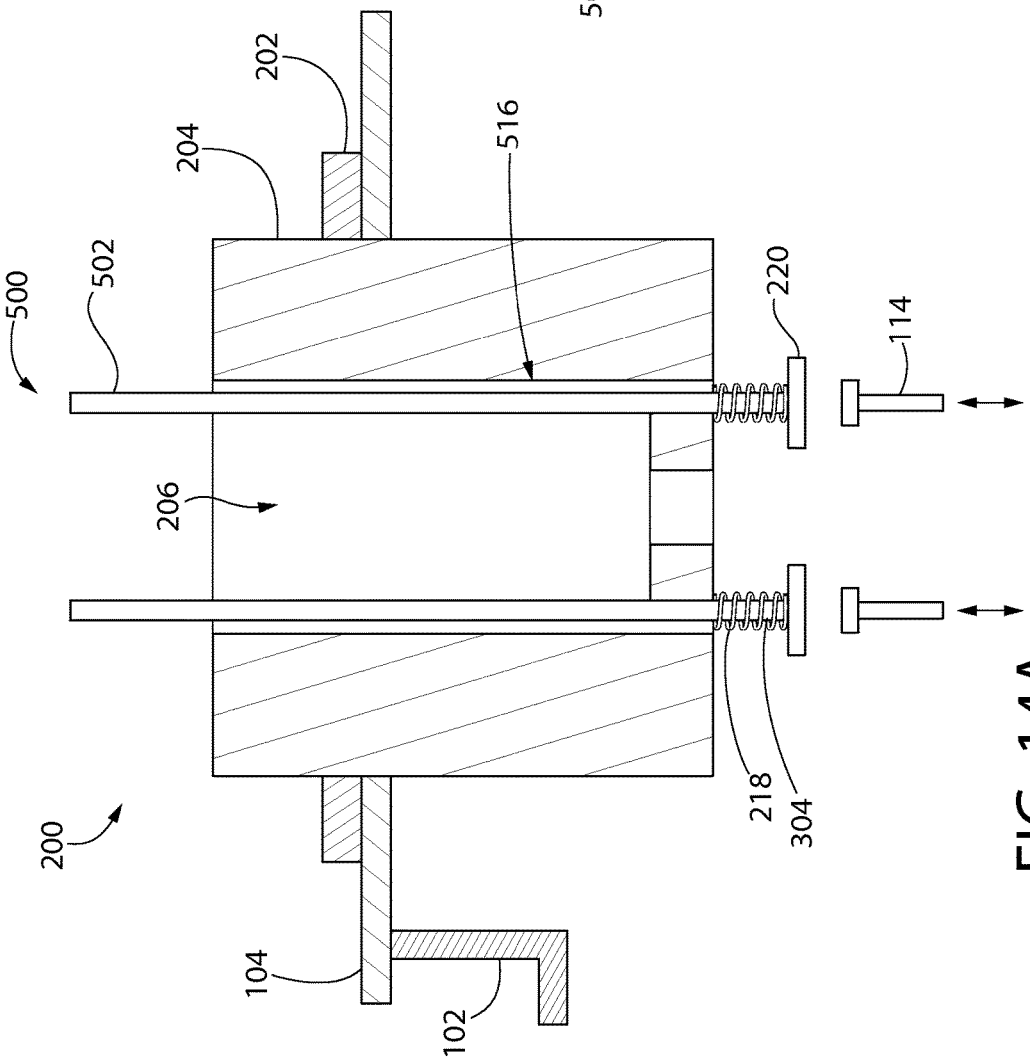

10A is a top plan view of the tube holder and shaping device of FIG. 4 showing ovality in the top filling end of the tube prior to correction by the tube shaping device which is in the retracted position;

FIG. 10B is a top plan view thereof showing the top filling end of the tube after correction by the tube shaping device which is in the extended position;

FIG. 10C is a top plan view of the tube holder and a second embodiment of a retractable tube shaping device showing the top filling end of the tube after correction by the tube shaping device which is in the extended position;

FIG. 10D is a top plan view of the tube holder and a third embodiment of a retractable tube shaping device showing the top filling end of the tube after correction by the tube shaping device which is in the extended position;

FIG. 11 is a side cross sectional view of the tube holder of FIG. 4 showing an alternative configuration of the means for actuating the first embodiment of the tube shaping device;

FIG. 12A is a side cross sectional view of the tube holder and the second embodiment of the retractable tube shaping device;

FIG. 12B is a top plan view of one of the straightening elements of the second embodiment of the tube shaping device;

FIG. 13 is a side cross sectional view of the tube holder of FIG. 12A showing an alternative configuration of the means for actuating the second embodiment of the tube shaping device;

FIG. 14A is a side cross sectional view of the tube holder showing the third embodiment of the retractable tube shaping device;

FIG. 14B is a top plan view of one of the straightening elements of the third embodiment of the tube shaping device;

FIG. 14C is a perspective view thereof; and

Figure 15:
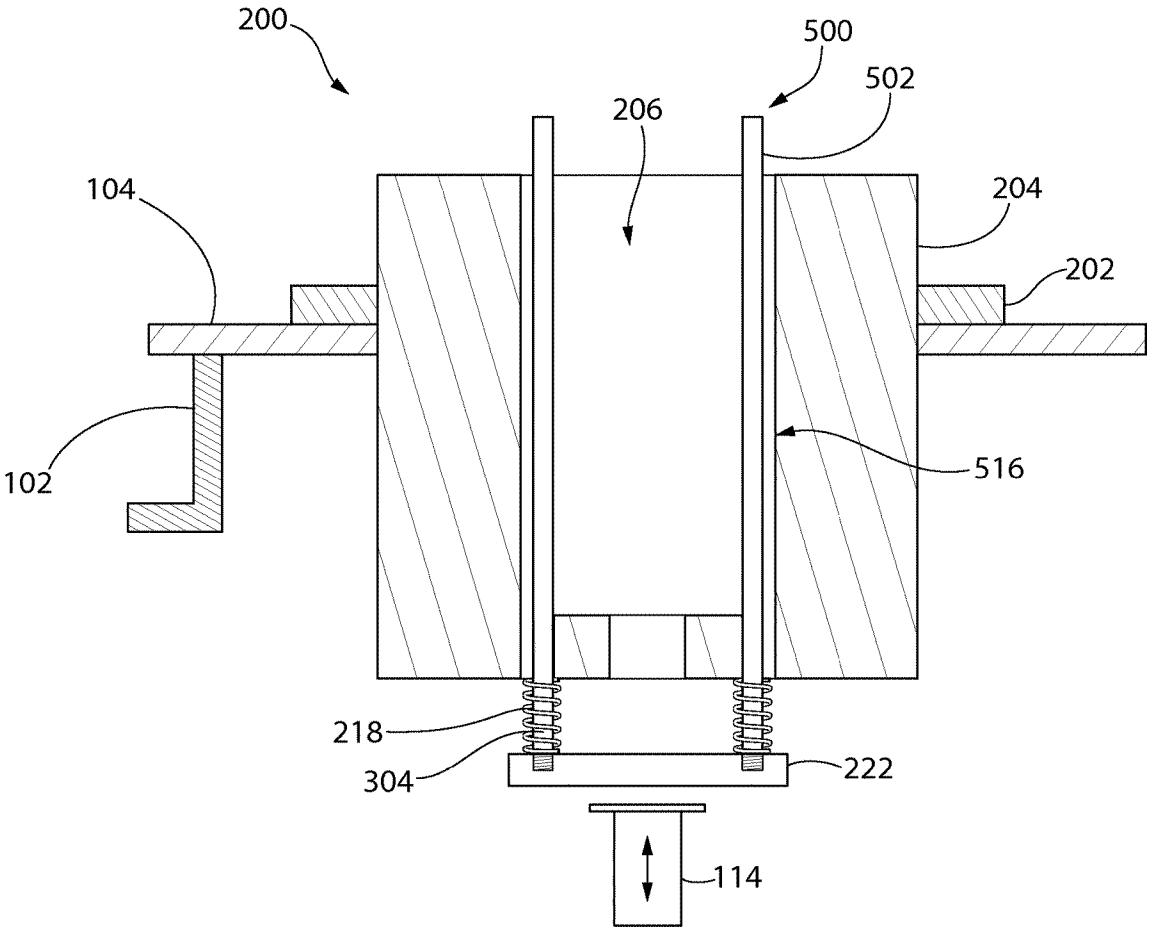

FIG. 15 is a side cross sectional view of the tube holder of FIG. 14A showing an alternative configuration of the means for actuating the third embodiment of the tube shaping device.

All drawings are schematic and not necessarily to scale.

DETAILED DESCRIPTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 1:
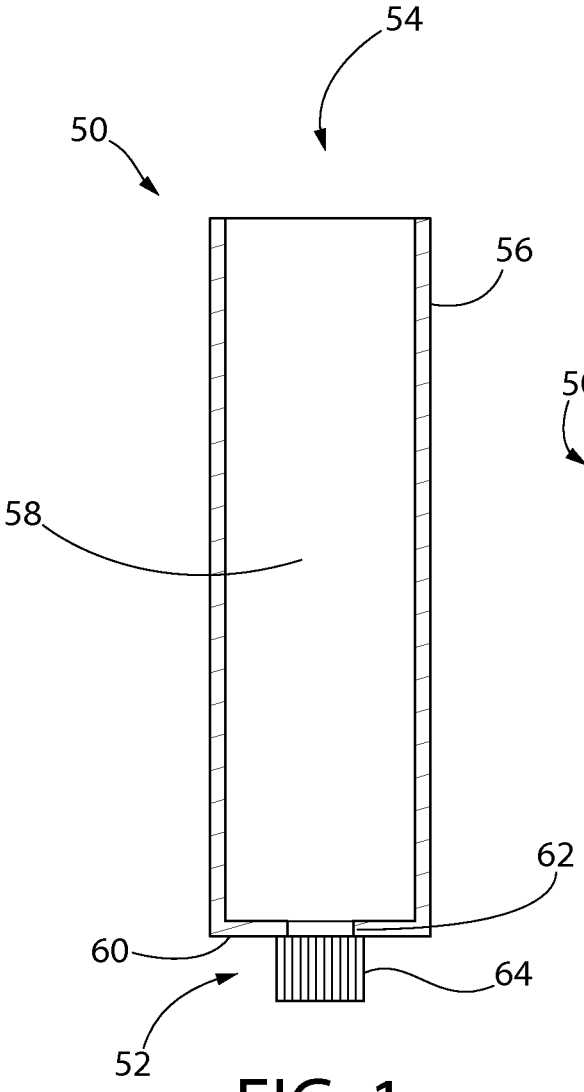
FIG. 1 is a side cross sectional view of a product tube prior to closing the top filling end.
Figure 2:
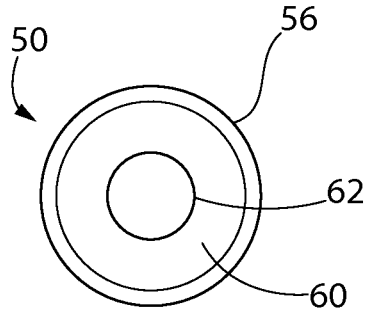
FIG. 2 is a top plan view thereof.

A laminated tube is shown in FIGS. 1 and 2. Tube 50 includes a bottom dispensing end 52, a top filling end 54, and convexly-shaped cylindrical sidewalls 56 extending therebetween. Filling end 54 is open prior to filling and closing the tube. Sidewalls 56 define an internal cavity 58 which is filled with a product to be stored in the tube 50. The dispensing end 52 includes a shoulder 60 and a nozzle 62 extending therefrom. The nozzle 62 may be closed by a removable cap 64 which may engage the nozzle in any manner. In one embodiment, cap 64 may threadably engage the nozzle. Other types of closure mechanisms such as friction or snap fit caps may be used.

In one embodiment, the shoulder 60 and nozzle 62 may have thicker walls and be more structured than the sidewalls 56 which may be more flexible and resilient being subject to greater deformability. The sidewalls 56 may have a generally circular shape in cross section complementing and conforming to the shape of shoulder 60 (in top plan view best shown in FIG. 2). Maintaining this circular shape is accomplished by embodiments of the present invention during the tube filling operation until the open filling end 54 of tube 50 is closed and sealed after placement of the product in the tube. This ensures that the top filing end is within the maximum ovality acceptable tolerance of the tube filling machine for proper filling nozzle 112 insertion.

The product filled in the tube 50 may be any type of flowable composition or substance including solids (e.g. powder, granules, pellets, etc.), liquids, or viscous liquids such as pastes, gels, or creams of various types. In certain embodiments, for example without limitation, the product material may be an oral care material or a personal care material. Other types of products however may be used. Accordingly, the invention is not limited to the type of material emplaced in the tube.

Tube 50 may be formed of any type material. In one embodiment, the tube 50 may be a monolayer or multilayered plastic tube formed of a suitable polymer selected for the product to be stored therein. The sidewalls 56, shoulder 60, and nozzle 62 may be formed of the same or different types of plastics. In some examples, the plastic may be a polyolefin thermoplastic such as polyethylene, polypropylene, or others.

Figure 3:
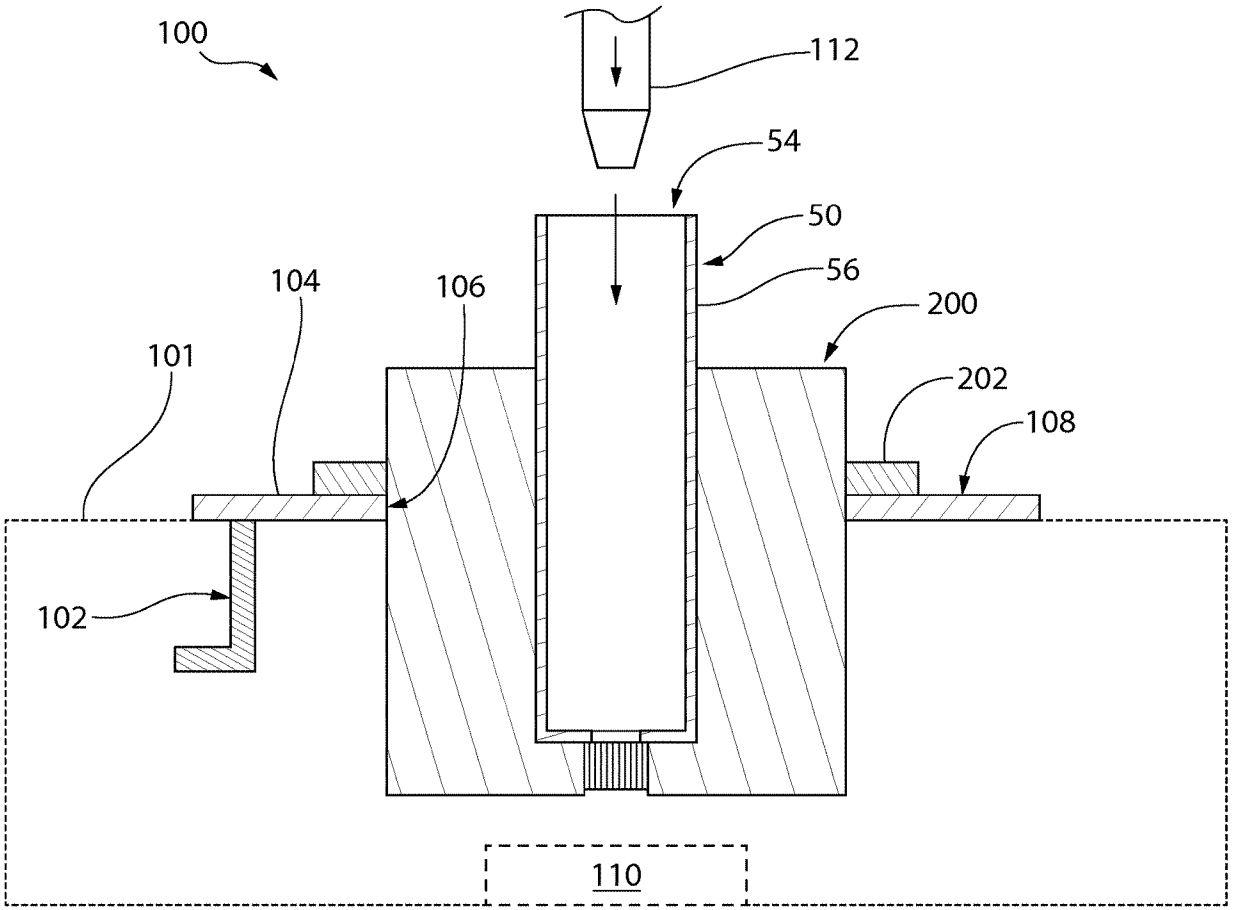
FIG. 3 is a partial side cross sectional view of a tube filling machine with tube holder.
Figure 5:
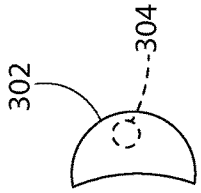
FIG. 5 is a top plan view of one of the straightening elements of the tube shaping device of FIG. 4.
Figure 6:
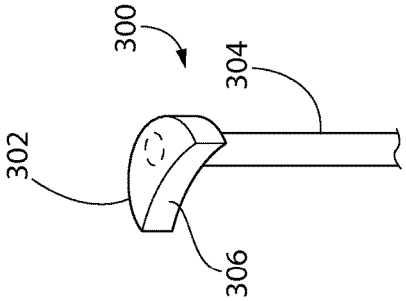
FIG. 6 is a perspective view thereof.

Referring initially now to FIG. 3, a tube holder with tube shaping device will be described in accordance with a first embodiment of the present invention.

A tube filling machine 100 includes a frame 101 supporting a moving conveyor 102 that transfers a tube holder 200 between process stations which may include tube supply, filling, sealing, and removal stations. The tube filling machine 100 thus operates to automatically fill and seal a plurality of tubes in sequential order with the intended product from start to finish in a continuous and efficient manner.

A movable carrier 104 is supported by the conveyor 102 which includes a plurality of receptacles 106 each configured for supporting a tube holder 200. Receptacles 106 may be in the form of a hole sized to at least partially allow insertion therein for retaining the tube holder 200. Tube holder 200 may include an annular flange 202 which engages the top surface 108 of carrier 104 to limit the insertion depth of the tube holder and support the holder. In certain embodiments, the carrier 104 may be a rotatable turntable or carousel which transports the tube holders 200 and tubes therein in a circular pattern between the various process stations positioned around conveyor 102 in the tube filling machine 100. In other possible arrangements, the carrier 104 may be a linearly movable apparatus in which the process stations are arranged along a linear path of the conveyor 102 from start to finish. Any type of process flow and equipment arrangement may thus be used with the present invention.

Tube filling machine 100 includes a drive mechanism 110 which is used to actuate the tube shaping device 301. The drive mechanism may be pneumatic, hydraulic, electric, or a combination thereof. The drive mechanism 110 may be separate from or a part of the conveyor drive equipment or other equipment of the tube filling machine that may control the other appurtenances provided such as tube sealing, empty tube fill loading to the carrier, or filled/sealed tube ejection operations.

A fill nozzle 112 may be supported by the frame 101 of the tube filling machine 100 and positioned above carrier 104. At the tube filling station, the end or tip of the nozzle is inserted into the open top filling end 54 of the tube 50 for introducing the product. In various embodiments, the nozzle 112 may remain stationary while the tube holder 200 is raised from the carrier 104 by a lifting mechanism of the tube filling machine 200 at the filling station (e.g. pneumatic, mechanical or electrically actuated drive member), or alternatively the tube holder 200 may remain stationary and seated in the carrier 104 while the fill nozzle is lowered. Either type of tube filling scenario and operation may be used with embodiments of the present invention.

Referring to FIGS. 3-7 now, tube holder 200 in one embodiment includes a body 204 defining a vertically elongated open chamber or channel 206 forming a receptacle configured for holding tube 50. Body 204 includes a top surface 210 and bottom surface 212. Annular mounting flange 202 projects radially outwards from lateral sides 214. In one embodiment, the body 204 may have a generally cylindrical shape; however, other suitable shapes may be used depending on the construction and configuration of the tube filling machine carrier 104.

Chamber 206 may have a generally cylindrical shape defining a vertical centerline Cv including an upper portion 206A configured for holding sidewalls 56 of tube 50 and lower portion 206B configured to form a seat for holding tube shoulder 60 and dispensing nozzle 62. Lower portion 206B includes a reduced diameter section sized to receive the capped tube dispensing nozzle 62. Upper portion 206A has an open top 208 for inserting and receiving tube 50 for processing and filling in the tube filling machine 100. Chamber 206 has a complementary shape to the tube 50 intended to be carried therein.

Tube holder 200 may have a monolithic single unitary structure or may be formed of two or more sections (e.g., halves split vertically or horizontally) which are permanently or removably coupled together by suitable mechanical means (e.g. fasteners, welding, etc.). Tube holder 200 may be formed of any suitable metal or non-metal material. In some embodiments, without limitation, the holder 200 is made of metal such as aluminum, titanium, steel, etc. which is amenable to machining and forming.

A retractable tube shaping device 301 is provided for straightening the sidewalls 56 and top filling end 54 of tube 50 for filling. In a first embodiment shown in FIGS. 4-7, the tube shaping device may be include a plurality of retractable straightening elements 300 arranged and spaced circumferentially around chamber 206. Elements 300 are supported by tube holder 200 and vertically oriented having an elongated shape and a length. An inward facing bearing surface 306 is positioned and configured on each element 300 to engage sidewalls 56 of tube 50 when inserted in the tube holder 200.

In this present embodiment, bearing surfaces 306 are arcuately and concavely shaped to engage the convexly shaped circular sidewalls 56 of tube 50 (see, e.g. FIG. 10B). In other embodiments, bearing surfaces 306 may be flat or planar. In one embodiment, the bearing surfaces 306 may each be formed on an enlarged crescent-shaped tube bearing member 302 affixed to an actuator rod 304. Each rod 304 is slidably disposed in a vertically-extending circular-shaped passageway 216 which extends between and penetrates top and bottom surfaces 210, 212 of tube holder 200. Tube bearing members 302 is positioned vertically on rod 304. In one configuration, tube bearing members 302 may be connected to the top of rod 304; however, other suitable positions along the rod between its top and bottom ends may be used.

It will be appreciated that other shapes may be used for tube bearing member 302 including various rectilinear and polygonal configurations so long a bearing surface 306 that engages tube 50 is provided. The invention is expressly not limited in shape therefore to the bearing member 306 shown and disclosed herein.

Actuator rod 304 may also have any suitable shape in transverse cross-section, including round, oblong, rectilinear (e.g. square or rectangular), and polygonal (e.g. triangular, hexagonal, trapezoidal, etc.). Other shapes may be used.

Figure 7:
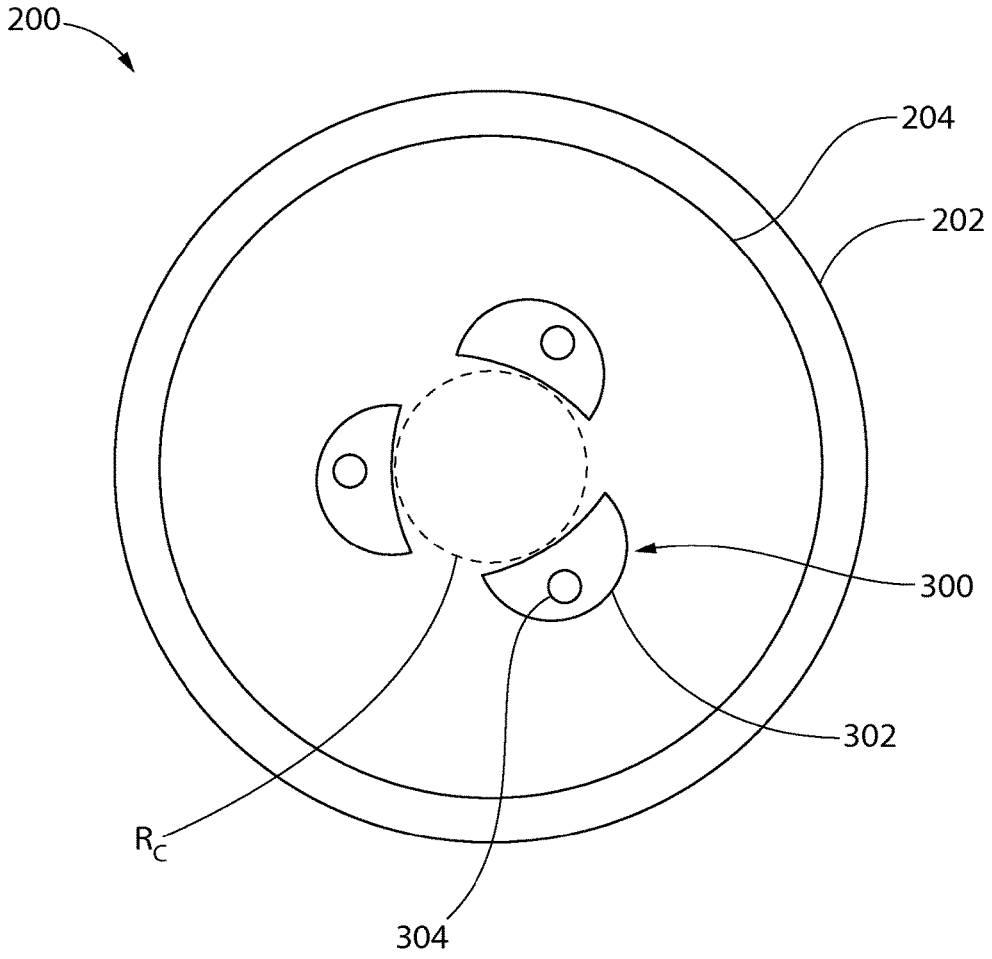
FIG. 7 is a top plan view of the tube holder and tube shaping device of FIG. 4.

Referring to FIG. 7 showing a top plan view of the tube holder 200, the actuator rods 304 are spaced circumferentially and uniformly around chamber 206 in tube body 204. The rods 304 are also radially spaced apart from chamber 206 by a distance which places the bearing surfaces 306 on each tube bearing member 302 in position to engage the sidewalls 56 of tube 50 since the rods themselves do not engage the tube.

Any suitable number of straightening elements 300 may be provided so long as any ovality present in tube 50 prior to filling may be reduced to within maximum acceptable ovality tolerance required by the tube filling machine for insertion of the filling nozzle 112 into the open filling end 54 of the tube. In certain embodiments, at least two diametrically opposed straightening elements 300 preferably may be provided. In other embodiments, three or four elements 300 may be provided. The number of straightening elements 300 will depend at in part to the circumferential extent or arc length of the bearing surfaces 306 provided on each element. Restraining the tube sidewalls 56 in at least two opposing locations with straightening elements 300 having relatively larger tube bearing members 302 and correspondingly sized surfaces 306 may be sufficient in some designs to force any ovality back within the desired circular shape needed for filling. In other designs having relatively smaller bearing members and surfaces 306, more straightening elements 300 may be needed to reduce the ovality. Importantly, it should be noted that because the resilient tube sidewalls 56 at the open filling end 54 will tend to return to their cylindrical shape when opposing inward radial straightening forces are applied against the sidewall surfaces normal to the vertical centerline Cv. Accordingly, an inwardly directed radial force need not be applied to the entire circumference of the tube sidewalls 56 in order to straighten and return them to a circular shape.

The straightening elements 300 may be formed of any suitable metal or non-metal material. In some embodiments, without limitation, the elements 300 are made of metal such as aluminum, titanium, steel, etc.

Figure 8:
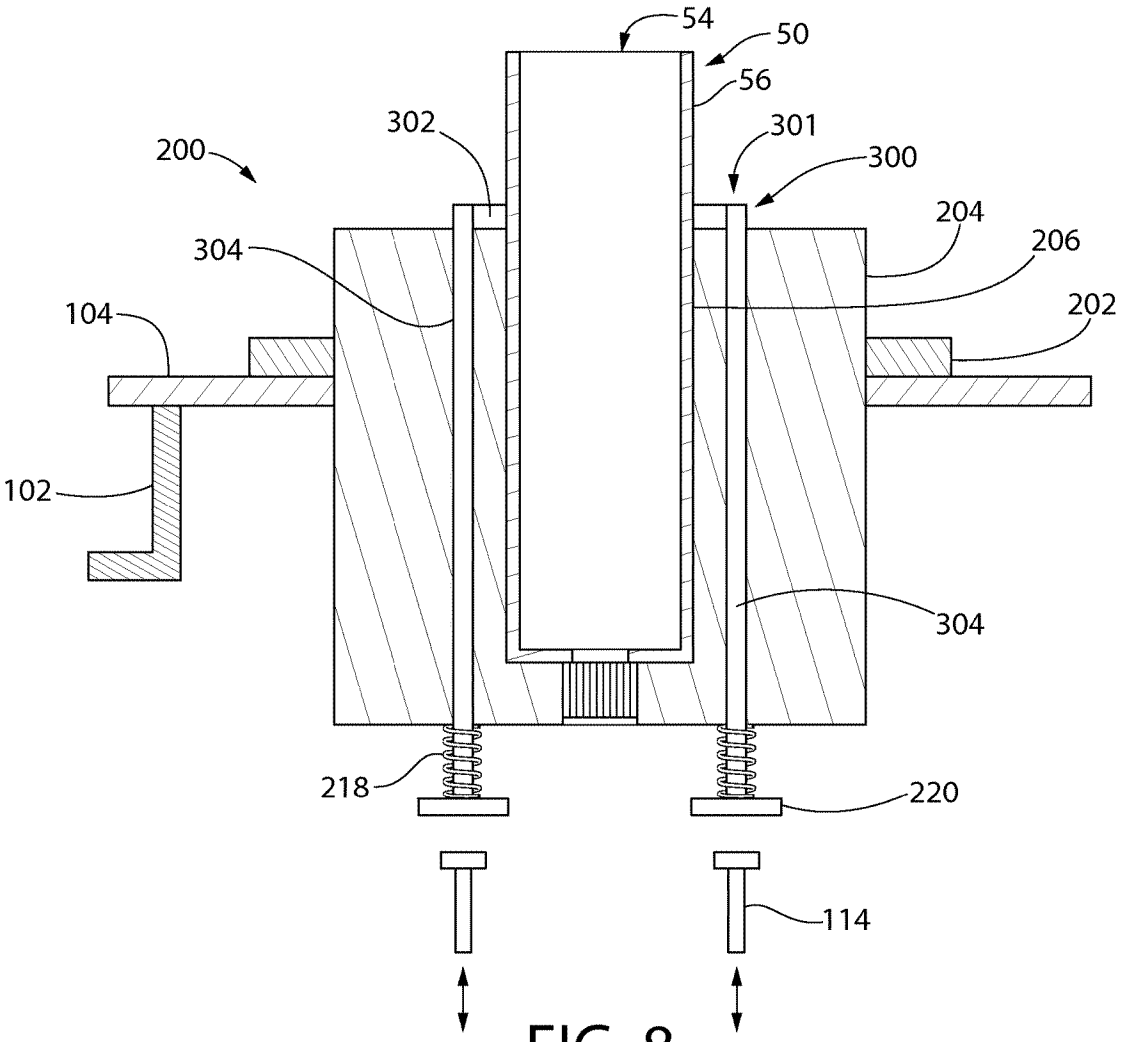
FIG. 8 is side cross sectional view of the tube holder of FIG. 4 showing the tube shaping device in a downward retracted position.
Figure 9:
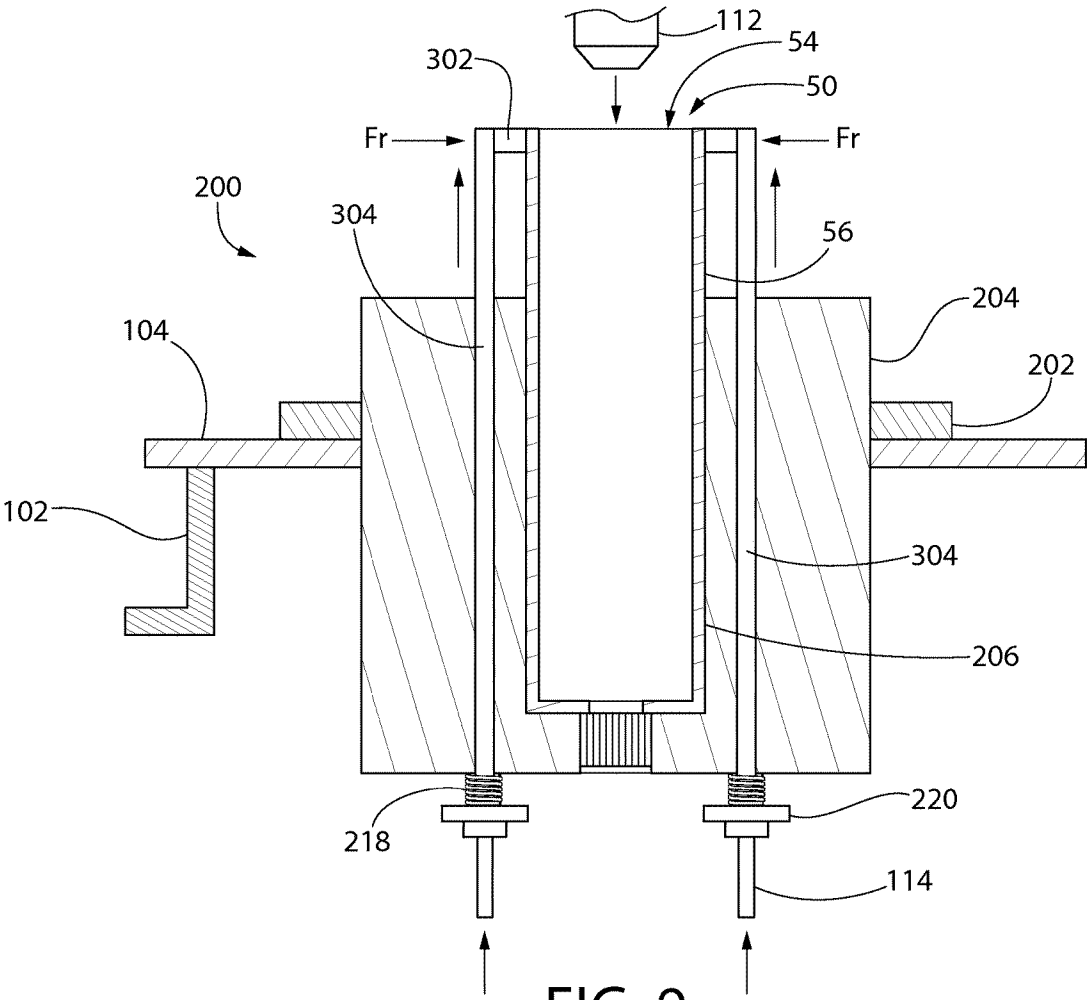
FIG. 9 is side cross sectional view of the tube holder of FIG. 4 showing the tube shaping device in an upward extended position.

Straightening elements 300 with bearing surfaces 306 are vertically and linearly movable from a downward retracted position (see, e.g. FIG. 8) to an upward extended position (FIG. 9). In the retracted position, the top of the straightening elements 300 and tube bearing members 302 thereon are located proximate to and may contact top surface 210 of the tube holder 200. In some embodiments, the bearing members 302 may rest on the top surface 210. In other embodiments, the top surface of the straightening elements 300 and bearing members 302 may be substantially flush with the top surface 210 of the tube holder 200 wherein the bearing members 302 may be seated in recesses formed in the tube holder. The recesses may have a shape complementary to the shape of the bearing members 302.

In the upward extended position, the bearing members are located more distally from the top surface and positioned to engage and straighten the upper portions of tube sidewalls 56. Advantageously, the ability to retract the straightening elements 300 ensures that the elements do not interfere with the process stations for initially loading the tubes 50 into the tube holder 200 and removing the tubes from holder. The straightening elements 300 are thus extended only when required to straighten the tube sidewalls 56 and remove any objectionable ovality for the tube filling operation.

In one embodiment, straightening elements 300 may be biased towards the retracted position by springs 218. FIG. 4 shows one non-limiting arrangement and type of springs that may be used. In the depicted embodiment, springs 218 may be compression springs wound around the lower portion of actuator rods 304. The springs 218 disposed are between the tube holder bottom surface 212 and spring retention members 220 coupled to the bottom ends of the rods 304. In one embodiment, retention members 220 are removably coupled to the bottom of the rods 304 such as via a threaded connection or set screw to allow the springs to be replaced if needed. The retention members 220 may have any shape, including a disk shape as shown and may be diametrically larger than the bottom ends of the rods 304 to which they are attached. The tube bearing members 302 may act as a travel limit stop for actuator rods 302 when the bearing members abuttingly engage the top surface 210 of the tube holder body 204 to prevent ejecting the rods from the tube holder.

The tube straightening elements 300 are actuated by the drive mechanism 110 which may include drive members 114 for engaging actuator rods 302, as shown in FIG. 4. The drive members 114 may be in the form of pistons, arms, or other linkages or devices. In one embodiment shown, each drive member 114 may include a rod coupled to the drive mechanism 110 having an enlarged top head that engages the underside of the spring retention member 220 for raising and lowering the straightening element 300. In the depicted arrangement, each actuator rod 302 has its own drive member 114.

In an alternative embodiment shown in FIG. 11, the bottom ends of the actuator rods 302 are attached to a common support header 222 which is actuated by a single larger drive member 114. This arrangement is mechanically simpler and ensures all straightening elements 300 are actuated in unison and uniformly. Support header 222 may have any suitable shape, including a circular, ring, disk shape, rectilinear, polygonal, or others depending on the layout of the straightening elements 300 to be actuated. It will be appreciated that numerous variations for actuating straightening elements 300 may be used. For example, without limitation, each straightening elements 300 or the support header 222 (depending on the arrangement used) may be attached directly to the drive member, thereby eliminating the springs 218. The extended and retracted positions of the straightening elements 300 are thus controlled directly by the vertical position of the drive member 114 at all times. Other variations are possible for actuating the straightening elements 300.

Operation of the tube holder 200 and shaping device 301 will now be discussed. The goal of the shaping device 301 (e.g. straightening elements 300) is to bring any ovality of the upper tube portion and open filling end 54 back into specification within the maximum ovality acceptable tolerance. The maximum ovality acceptable tolerance may be visually represented by an imaginary target reference circle Rc illustrated in FIG. 7 (top plan view) by the dashed-line circle between the straightening elements 300.

Referring to FIG. 8, the empty tube 50 is shown already inserted into chamber 206 of tube holder 200 to a fixed depth. The tube cap 64 is in place on dispensing nozzle 62 closing the dispensing end 52 of the tube. The upper portion of the tube sidewalls 56 extend for a vertical distance above the top surface 210 of the tube holder 200 to provide access for filling and subsequent closure/sealing of the now still open tube filling end 54. The straightening elements 300 of the tube shaping device 301 are shown in the downward retracted position with tube bearing members 302 abuttingly engaging the top surface 210 of tube holder 200. The bearing members 302 may be located proximate to or lightly engaging sidewalls 56 of the tube 50.

The upper portions of the tube sidewall 56 are assumed to still be partially collapsed inward imparting an oval cross-sectional shape to the tube as represented by the dashed-line oval shown in FIG. 10A. This ovality deviates from the target reference circle Rc (FIG. 7) needed to properly insert and fill the tube 50 with product from filling nozzle 112.

At the same time or before the empty tube 50 reaches the filling station as shown in FIG. 9, the shaping device 301 is actuated to reduce the ovality of the filling end 54 of the tube. Each actuator rod 304 of the straightening elements 300 is engaged by its respective drive member 114 which is raised vertically by drive mechanism 110 (FIG. 3). The members 114 push and raise each of the straightening elements 300, which in turn compresses springs 218. As the actuator rods 304 move upwards, the bearing surfaces 306 of the tube bearing member 302 slidably engage or more deeply slidably engage the oval-shaped sections of the annular upper tube sidewalls 56 as the bearing surfaces travel along opposing sections of the sidewalls. This applies an inwardly directed radial force Fr against and normal to the sidewalls which forces the sidewalls and upper filling end 54 of the tube 50 back to a circular cross-sectional shape as shown in FIG. 10B. The filling end 54 is now back within the maximum ovality acceptable tolerance of the filling machine 100 and generally matches the target reference circle Rc shape. Shaping device 301 (e.g. straightening elements 300) is now in the upward extended position. The filling end 54 thus presents a round or circular cross-sectional profile to the fill nozzle 112 and is readied for filling.

The shaping device 301 continues to apply the radial force Fl against the tube sidewalls 56, thereby maintaining the circular shape of the filling end 54 at least until the fill nozzle 112 is inserted into the tube 50 as illustrated in FIG. 9. As already noted herein, this may be done by lowering the nozzle 112 or raising the tube holder 200 and tube 50 in unison.

Once the tube 50 is filled with the desired product dispensed from fill nozzle 112, the shaping device 301 (e.g. straightening elements 300) may be returned to its downward retracted position shown in FIG. 8. As the drive members 114 are lowered by drive mechanism 110, springs 218 expand and automatically return the straightening elements 300 downward without vertical support from the drive members. The now filled tube 50 may then be transported to the tube closure/sealing station by carrier 104. Alternatively, depending on the type of seal used to close the filling end 54 of the tube, the shaping device 301 may also be either maintained in the upward extended position or partially lowered between the extended and retracted position (see, e.g. position in FIG. 4) via pre-set operation of the drive mechanism 100 and positioning of the drive members 114.

It will be appreciated that numerous variations for filling a tube using shaping device 301 are possible.

FIGS. 12A, 12B, and 10D show an alternative second embodiment of a shaping device 400 which operates in a similar manner to shaping device 301 described above. In lieu of the tube bearing members 302 being separate components attached to actuator rods 304, tube bearing rods 402 are provided which themselves form the retractable straightening elements which are each configured and arranged to engage the tube 50 for straightening and correcting tube ovality. At least three bearing rods 402 are provided which are circumferentially spaced apart uniformly around chamber 206 of tube holder 200. In the embodiment shown in FIG. 12, four uniformly spaced actuator rods 402 are provided to ensure each quadrant of the tube sidewalls 56 is engaged. The present actuator rods 402 may be positioned immediately adjacent to or partially penetrate chamber 206 and extend vertically along the entire length or height of the chamber as shown. This positioning allows the rods 402 to slidably engage the sidewalls 56 of tube 50. The rods 402 travel upwards and downwards in vertically-extending circular-shaped passageway 416 in tube holder body 204. The bearing surfaces 406 have a convex shape being defined by the inward facing portions and surfaces thereon of the actuator rods 402. Accordingly, in this embodiment, the bearing surfaces 406 are vertically continuous along the entire length or height of the rods 402.

FIG. 13 shows a variation of shaping device 400 in which the actuator rods 402 are mounted on the common support header 222 similarly to actuator rods 304 described above and shown in FIG. 11.

FIGS. 14A-C and 10C show an alternative third embodiment of a shaping device 500 which operates in a similar manner to shaping device 301 described above. In this embodiment, shaping device 500 includes retractable straightening elements configured as a pair of diametrically opposed vertically split and vertically elongated partial sleeves 502. The sleeves 502 may be convexly shaped as arc segments in transverse cross section therefore having an arcuate shape when viewed from the top. Sleeves 502 each define a concavely shaped bearing surface 504 facing inwards on tube holder 200 which engages the convex sidewalls 56 of tube 50 for straightening and correcting tube ovality. The sleeves 502 and their bearing surfaces 504 each have an arc length or width which is less than 180 degrees in this embodiment. Therefore, the ends of each of the sleeves 502 may be separated and spaced laterally apart from each other (best shown in FIG. 10C) which is beneficial for several reasons. First, the entire circumference of the tube sidewalls 56 does not require engagement with the sleeves 502 to be straightened sufficiently to remove tube ovality, as explained elsewhere herein. Second, in lieu of a circumferentially continuous tubular sleeve which slides up/down, the lower portion 206B of the tube holder which includes the seat formed by a reduced diameter portion that engages the shoulder/cap of the tube 50 (see also FIGS. 3-4) is more easily supported by the tube holder material extending radially inwards between the opposed and separated sleeve ends. This shoulder/cap seat will therefore preferably remains stationary with respect to the tube holder 200 when the straightening elements (sleeves 502) are actuated and extended so that the tube 50 remains in a constant position in relation to the tube holder. In other possible embodiments, however, it will be appreciated that a single continuous tubular sleeve (un-split) may alternatively be provided.

In one embodiment, each sleeve 502 may include an integrally attached or formed actuator rod 304 disposed on the bottom of the sleeves. The rods 304 are vertically oriented and extend downwards from each sleeve 502. Each rod 304 include a springs 218 and spring retention member 220 affixed to the bottom terminal end of the rod. The drive members 114 engage the retention members 220 to actuate the sleeves 502. The sleeves 502 may be positioned immediately adjacent to (and spaced apart from) the chamber 206, or instead fully penetrate chamber 206 thereby actually forming a movable sidewall portion of the chamber 206. The sleeves 502 may extend vertically along the entire length or height of the chamber 206 as shown. This positioning allows the sleeves 502 slidably engage the sidewalls 56 of tube 50. The sleeves 502 travel upwards and downwards in vertically-extending arcuately-shaped passageways 516 in tube holder body 204 which complements the shape and curvature of the sleeves. Other arrangements and configurations of sleeves 502 are possible.

In the present embodiment shown, at least two diametrically opposed sleeves 502 are provided. In other possible embodiments, three or more sleeves may be provided which may each have a smaller arc length or width than the two sleeve embodiment and ensure each quadrant of the tube sidewalls 56 is engaged.

FIG. 15 shows a variation of shaping device 500 in which the actuator rods 304 are mounted on the common support header 222 similarly to actuator rods 304 described above and shown in FIG. 11.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A tube holder for carrying a tube to multiple processing stations of a tube filling machine, the tube holder comprising:

a body comprising an open chamber having a longitudinal centerline, the open chamber being configured for retaining a tube, the body having a top surface, the tube having an internal cavity for storing a product, a dispensing end, and an open filling end;

a retractable tube shaping device movably disposed in the body, the shaping device extending from a first end to a second end, the shaping device being movable parallel to the longitudinal centerline between a longitudinally extended position in which the second end of the shaping device is longitudinally away from the top surface of the body and a longitudinally retracted position in which the second end of the shaping device is longitudinally proximate to the top surface of the body;

wherein the shaping device is configured such that, when in the extended position, the second end of the shaping device engages an outer surface of the tube proximate to the open filling end and imparts a circular cross sectional shape to the tube for filling the cavity.

2. The tube holder according to claim 1, wherein the body is cylindrical in shape.

3. The tube holder according to claim 1, wherein the tube shaping device comprises a plurality of elongated vertically retractable straightening elements disposed around the chamber in the body of the tube holder.

4. The tube holder according to claim 3, wherein the straightening elements extend from the first end to the second end, wherein the second end is proximate to the top surface of the body when in the retracted position, the second end being distal to the top surface of the body when the straightening elements are in the extended position.

5. The tube holder according to claim 3, wherein the straightening elements are each slidable in a vertically extending passageway formed between the top surface and a bottom surface of the body of the tube holder.

6. The tube holder according to claim 1, wherein the tube shaping device is vertically movable between the extended and retracted position.

7. The tube holder according to claim 1, further comprising a biasing member that biases the tube shaping device towards the retracted position.

8. The tube holder according to claim 1, wherein the tube shaping device is actuated by a drive mechanism from beneath a bottom surface of the tube holder.

9. The tube holder according to claim 1, wherein the tube shaping device includes a plurality of actuator rods.

10. A tube holder for carrying a tube to multiple processing stations of a tube filling machine, the tube holder comprising:

a body comprising an open cylindrical chamber having a centerline oriented vertically, the chamber being configured for retaining a tube in an upright position, the tube having an internal cavity for storing a product, a dispensing end, and an open filling end;

a plurality of elongated retractable straightening elements movably disposed in the body and spaced circumferentially apart around the chamber, the straightening elements each extending from a first end to a second end comprising a bearing surface configured to engage the tube when the tube is seated in the chamber, the straightening elements vertically movable between an upward extended position and a downward retracted position;

wherein when the straightening elements are in the upward extended position, the second ends of the straightening elements are positioned to engage an outer surface of tube proximate to the open end and impart a circular cross sectional shape to the tube for filling the cavity.

11. The tube holder according to claim 10, wherein the bearing surfaces are convexly shaped.

12. The tube holder according to claim 10, wherein bearing surfaces are each formed on an inward facing surface of a tube bearing member attached to or formed on an actuator rod.

13. The tube holder according to claim 12, wherein the bearing member has a crescent shape.

14. The tube holder according to claim 10, wherein at least some of the bearing surfaces slide upwards along the tube from a point closer to the dispensing end of the tube to a point closer to the filling end of the tube when the straightening elements move from the retracted to extended position.

15. The tube holder according to claim 10, wherein the straightening elements are each slidable in a vertically extending passageway formed between top and bottom surfaces of the body of the tube holder.

16. The tube holder according to claim 10, further comprising a plurality of springs, each spring biasing a straightening element towards the retracted position.

17. The tube holder according to claim 10, wherein the straightening elements have a convexly curved sleeve shape.

18. A method for filling a tube, the method comprising:

providing a tube including an internal cavity having a vertical longitudinal centerline, a dispensing end, and an open filling end;

providing a tube holder configured to hold the tube in an upright position, the tube holder including a tube shaping device movably disposed in the tube holder and retractable parallel to the centerline;

inserting the dispensing end of the tube into the tube holder;

vertically extending the tube shaping device longitudinally away from a top surface of the tube holder towards an extended position;

engaging an outer surface of an upper end of the tube proximate to the open filling end with the shaping device;

conforming the cross sectional shape of the upper portion to a target filling reference circle; and filling the cavity of the tube with a product.

19. The method of claim 18, further comprising vertically retracting the tube shaping device back towards the top surface of the tube holder towards a retracted position after filling the cavity of the tube.

20. The method of claim 19, further comprising biasing the tube shaping device towards the retracted position.

* * * * *